US006798384B2

(12) United States Patent
Aikawa et al.

(10) Patent No.: US 6,798,384 B2
(45) Date of Patent: Sep. 28, 2004

(54) MULTI-ELEMENT PLANAR ARRAY ANTENNA

(75) Inventors: Masayoshi Aikawa, Kanagawa (JP); Eisuke Nishiyama, Saga (JP); Fumio Asamura, Saitama (JP); Takeo Oita, Saitama (JP)

(73) Assignees: Nihon Dempa Kogyo Co., Ltd., Tokyo (JP); Masayoshi Aikawa, Kanagawa (JP)

( * ) Notice: Subject to any disclaimer, the term of this patent is extended or adjusted under 35 U.S.C. 154(b) by 0 days.

(21) Appl. No.: 10/422,503

(22) Filed: Apr. 24, 2003

(65) Prior Publication Data

US 2003/0201941 A1 Oct. 30, 2003

(30) Foreign Application Priority Data

Apr. 26, 2002 (JP) ..... 2002-127074

(51) Int. Cl.[7] ..... H01Q 1/38
(52) U.S. Cl. ..... 343/700 MS; 343/770
(58) Field of Search ..... 343/700 MS, 767, 343/768, 770

(56) References Cited

U.S. PATENT DOCUMENTS 4,916,457 A * 4/1990 Foy et al. ..... 343/770
4,985,708 A * 1/1991 Kelly ..... 343/771
5,025,264 A * 6/1991 Stafford ..... 343/767
5,270,721 A * 12/1993 Tsukamoto et al. .. 343/700 MS
5,278,569 A * 1/1994 Ohta et al. ..... 343/700 MS
5,418,541 A * 5/1995 Schroeder et al. ... 343/700 MS
5,502,453 A * 3/1996 Tsukamoto et al. ..... 343/756
5,619,216 A * 4/1997 Park ..... 343/771
6,218,978 B1 * 4/2001 Simpkin et al. ..... 342/5
6,304,226 B1 * 10/2001 Brown et al. ..... 343/767
6,507,320 B2 * 1/2003 Von Stein et al. ..... 343/770
6,593,891 B2 * 7/2003 Zhang ..... 343/767

* cited by examiner

*Primary Examiner*—James Vonnucci
*Assistant Examiner*—Shih-Chao Chen
(74) *Attorney, Agent, or Firm*—Katten Muchin Zavis Rosenman

(57) ABSTRACT

A multi-element planar array antenna has a substrate made of a dielectric material or the like; a planar conductor formed on a first principal surface of the substrate; a first and a second slot line formed in the conductor and intersecting each other; a first and a second microstrip line formed on a second principal surface of the substrate, and traversing the first slot line respectively at positions corresponding to both end sides of the first slot line; a third and a fourth microstrip line formed on the second principal surface, and traversing the second slot line respectively at positions corresponding to both end sides of the second slot line; and four slot line antenna elements formed on the first principal surface respectively in intersection regions between both end sides of the first and second microstrip lines and both end sides of the third and fourth microstrip lines.

22 Claims, 11 Drawing Sheets

MULTI-ELEMENT PLANAR ARRAY ANTENNA

BACKGROUND OF THE INVENTION

1. Field of the Invention

The present invention relates to a multi-element planar array antenna which comprises a plurality of antenna elements arranged on a two-dimensional plane, and more particularly, to a multi-element planar array antenna which facilitates the utilization of polarization components, and can be readily reconfigured into an active antenna by mounting thereon a semiconductor device, IC (integrated circuit) and the like.

2. Description of the Related Arts

Planar antennas are widely used in, for example, radio communications, satellite broadcasting in a microwave band and a millimeter band. Planar antennas are classified into a microstrip line type, a slot line type, and the like. Generally, the microstrip line planar antenna is often used because of a simple structure in a feed system and the like. The slot line planar antenna is advantages in that it operates in a wide frequency band, readily suppresses an orthogonal component, and the like. In recent years, a so-called multi-element array structure using a plurality of antenna elements has been employed with the intention of improving the antenna gain which is a challenge for the microstrip line planar antenna.

As is well known, electromagnetic radiations include polarization components such as horizontal and vertical linear polarizations, and right-handed and left-handed circular polarizations. Many antennas making use of such polarization characteristics are widely used with the intention of, for example, sharing an antenna for transmission and reception, effectively utilizing the frequency resources, suppressing interference between transmission and reception.

FIGS. 1A to 1D are plan views respectively illustrating exemplary configurations of conventional planar antennas. Out of the illustrated planar antennas, those illustrated in FIGS. 1A, 1B and 1C are microstrip line planar antennas, while that illustrated in FIG. 1C is a slot line planar antenna. Each of these figures illustrates an exemplary configuration of a planar antenna having a single antenna element for producing a linear or a circular polarization.

The planar antenna illustrated in FIG. 1A is a microstrip line planar antenna for linear polarization which comprises square antenna element (i.e., circuit conductor) 21 and feed line 22 on one principal surface of substrate 23 made, for example, of a dielectric material. A ground plane conductor is disposed substantially over the entirety of the other principal surface of substrate 23. In this planar antenna, the antenna frequency (resonant frequency) is determined by the shape of antenna element 21, the dielectric coefficient of substrate 23, and the like. Also, in this planar antenna, a polarization plane of linear polarization for transmission and reception is set by a feeding direction in which feed line 22 is connected with respect to antenna element 21. Specifically, as indicated by arrows, a vertical polarization component can be transmitted and received when antenna element 21 is fed in the vertical direction (up-to-down direction in the figure), while a horizontal polarization component can be transmitted and received when antenna element 21 is fed in the horizontal direction (left-to-right direction in the figure).

The planar antenna illustrated in FIG. 1B is microstrip line planar antenna having square antenna element 21 on one principal surface of substrate 23, similar to the one illustrated in FIG. 1A, but differs in that antenna element 21 is fed at two points so that it is adapted for use with a circular polarization. Specifically, feed line 22 is branched into two in the middle such that one of the branch lines is used as a feed line for a vertical polarization component while the other is used as a feed line for a horizontal component. The feed lines for respective components differ in the electric length from each other by one quarter wavelength. As a result, a vertical polarization component is out of phase from a horizontal polarization component by 90 degrees ($\pi/2$), so that these polarization components are combined into a circular polarization. Consequently, the resulting planar antenna is capable of transmitting and receiving a circular polarization. It should be noted that the planar antennas illustrated in FIGS. 1A and 1B each utilize a degeneration mode in antenna element 21.

The planar antenna illustrated in FIG. 1C is a microstrip line planar antenna for circular polarization, in which degeneration is released in antenna element 21 to feed antenna element 21 at one point. In this planar antenna, portions of square antenna element 21 in a set of diagonal directions are cut away to release the degeneration so that resonance modes in two directions (vertical and horizontal directions) are out of phase by 90 degrees from each other at the operating frequency of the antenna, thereby providing the capabilities to transmit and receive a circular polarization.

FIG. 1D illustrates a slot line planar antenna for use with a circular polarization which releases degeneration in an antenna element. This planar antenna comprises antenna element 24 formed as a slot line that circumvents on one principal surface of substrate 23, instead of an antenna element in a microstrip line planar antenna. Antenna element 24 is rectangular in shape and released from the degeneration, thereby constituting a resonator at the antenna frequency. When antenna element 24 is fed at one corner thereof, resonance modes in the two directions are out of phase by 90 degrees from each other, similar to the foregoing, thereby providing the capabilities to transmit and receive a circular polarization.

Each of the conventional microstrip line and slot line planar antennas described above can be shared for a horizontal polarization and a vertical polarization, and transmit and receive the circular polarization when it is provided with a single antenna element alone. However, these conventional planar antennas are problematic in configuring a multi-element planar array antenna comprised of a plurality of antenna elements arranged in a two-dimensional plane while maintaining the above functions of the planar antenna having a single antenna element.

Specifically, any of the planar antennas of the types illustrated in FIGS. 1A to 1D encounters difficulties, when it is configured as a multi-element array, in implementing connections of the feed line to respective antenna elements, i.e., a feeder circuit on a single plane. For this reason, a multi-layer substrate, for example, should be used to implement a feeder circuit, in which case difficult designing is obliged for ensuring the same line lengths, for example, from a feed point, due to a requirement of exciting the respective antenna elements in phase.

Further, when the configuration illustrated in FIG. 1B is used for a circular polarization antenna, a phase difference feeder circuit is required for each antenna element to give a phase difference of 90 degrees (i.e., $\pi/2$). The planar antenna illustrated in FIG. 1C can operate only in a narrow frequency range on principles. Although there is an example of a linear array in which a coplanar line is connected to a feed line, the planar antenna illustrated in FIG. 1D is similar in that it encounters difficulties in double use of both vertical and horizontal polarization components, and an adaptation for a two-dimensional planar array antenna including a circular polarization.

As described above, the conventional planar antennas, whichever one is concerned, generally have a problem in the double use of polarizations, and the adaptation for a two-dimensional planar array antenna including a circular polarization.

SUMMARY OF THE INVENTION

It is an object of the present invention to provide a multi-element planar array antenna which has a two-dimensional array structure that can use polarizations together and use a circular polarization.

The inventors diligently investigated the configuration of planar antennas, and perceived the transmission characteristics and line structures of microstrip lines and slot lines formed on both sides of a substrate made of a dielectric material or the like, particularly perceived features of an anti-phase serial branch from the slot line to the microstrip line, and a circuit in which slot lines intersect each other, and reached the completion of the present invention by making the most of these features.

Specifically, the object of the present invention is achieved by a multi-element planar array antenna which includes a substrate having a first and a second principal surface, a conductor formed on the first principal surface, a first and a second slot line formed in the conductor, and intersecting each other, a first and a second microstrip line formed on the second principal surface, and traversing the first slot line respectively at positions corresponding to both end sides of the first slot line, a third and a fourth microstrip line formed on the second principal surface, and traversing the second slot line respectively at positions corresponding to both end sides of the second slot line, and four microstrip line antenna elements formed on the first principal surface respectively in intersection regions between both end sides of the first and second microstrip lines and both end sides of the third and fourth microstrip lines. Each antenna element is arranged for excitation in two directions by electromagnetically connecting to one of both ends of one of the first and second microstrip lines and to one of both ends of one of the third and fourth microstrip lines through the substrate for excitation in two directions. The two excitation directions of each antenna element are typically orthogonal to each other, and each antenna element is excited in phase.

The substrate for use in the present invention is made, for example, of a dielectric material. The conductor formed on the first principal surface of the substrate is, for example, a planar metal conductor. This conductor functions as a ground plane for the first to fourth microstrip lines.

In this multi-element planar array antenna, a feed point is typically at the intersection of the first and second slot lines. An excitation mode is selected for each antenna element by selecting at least two of four corners formed in the conductor at the intersection and applying a high frequency signal to the selected corners.

Specifically, in the present invention, the microstrip lines are routed on both end sides of a set of intersecting slot lines to traverse them, so that a high frequency signal in a balanced mode, propagating,through the slot line, is converted to an unbalanced mode by the microstrip lines, and propagates in anti-phase series branch. Also, an excitation direction in each antenna element can be selected by selecting corners of the conductor constituting the intersection of the set of the slot lines at the intersection, and applying a high frequency signal to the selected corners. For example, by selecting corners to apply a high frequency signal between the conductors on both sides of the first slot line, the high frequency signal is converted to the unbalanced mode by the first and second microstrip lines, and is fed to each antenna element in a direction orthogonal to the direction in which the first slot line extends. Similarly, by selecting corners to apply a high frequency signal between the conductors on both sides of the second slot line, each antenna element is fed in a direction orthogonal to the direction in which the second slot line extends. By thus selecting a feed mode at the intersection, one of the first and second slot lines can be excited, and an excitation direction can be selected for each antenna element, Thus, the multi-element planar array antenna can select one from linear polarizations in orthogonal directions as well as can use the linear polarizations together.

Further, as one pair of corners in a diagonal direction is selected from four corners at the intersection and applied with a high frequency signal, both slot lines are excited so that each antenna element is simultaneously fed from the two directions orthogonal to each other. As such, polarization components in the two directions are combined to provide a polarization component in an intermediate direction of the two directions. In addition, when the corners in the respective diagonal directions are formed in pairs, and each pair is applied with a high frequency signal at a different level, the polarization direction can be arbitrarily controlled to utilize any polarization component.

Moreover, when the first and second slot lines are set such that their electric lengths differ from each other by $\pi/2$ as calculated in terms of phase difference, a circular polarization can be transmitted and received by applying a high frequency signal to one pair of corners in one diagonal direction at the intersection. For example, a circular polarization can be generated by delaying a vertical excitation component in phase from a horizontal excitation component by $\pi/2$. In this event, a radiated electromagnetic wave can be a right-handed circular polarization or a left-handed circular polarization by selectively applying a high frequency signal to one or the other pair of corners positioned in the diagonal directions at the intersection. It is therefore possible to select a circular polarization, and again select a right-handed circular polarization or a left-handed circular polarization as well as to use the right-handed circular polarization together with left-handed circular polarization by simultaneously selecting both circular polarizations, wherein, by way of example, the right-handed circular polarization is transmitted while the left-handed circular polarization is received, thereby readily implementing a multi-element planar array antenna capable of selecting one from orthogonal circular polarizations and using them together.

Moreover, in the present invention, a 16-element planar array antenna and planar antenna having a larger number of antenna elements can be configured by utilizing an in-phase parallel branch of slot lines from microstrip lines.

As appreciated from the foregoing, the present invention can readily implement a four-element planar array antenna which can use together linear polarizations such as a horizontal polarization component and a vertical polarization component. The present invention can also implement a four-element planar array antenna which can use together orthogonal circular polarizations such as a right-handed circular polarization and a left-handed circular polarization.

In addition, the present invention can readily implement multi-element planar array antenna having 8-elements, 16-elements, 64-elements and the like. The present invention readily implements a planar array antenna which supports multiple bands by use of two frequencies. In essence, the present invention provides a slot line planar array antenna which can be readily configured as a two-dimensional array that can use multiple polarizations together or use a circular polarization.

Since the present invention utilizes the series branches from the slot lines to the microstrip lines, the antenna elements are complementary to each other in excitation, consequently providing a planar antenna which has suppressed orthogonal polarizations and good circular polarization axial ratio characteristics. Further, the planar antenna structure of the present invention facilitates mounting of a functional circuit such as a semiconductor device, an integrated circuit (IC) chip and the like, and therefore is effective in providing an active planar array antenna, an adaptive active planar array antenna, and a smart planar array antenna.

Since the multi-element planar array antenna according to present invention is based on integration of slot line antenna elements, electromagnetic waves radiate from both principal surfaces of the substrate. When a need exists for radiating an electromagnetic wave only from one of the principal surfaces of the substrate, an electromagnetic shielding box, a shielding plate, a reflector or the like may be provided on the other principal surface of the substrate.

DETAILED DESCRIPTION OF THE INVENTION

Figure 1A:
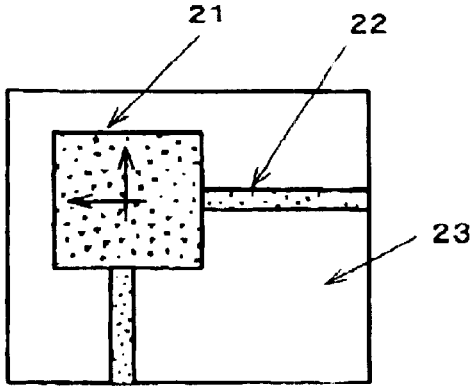
FIG. 1A (BACKGROUND ART)
FIGS. 1A to 1D are plan views each illustrating an exemplary configuration of a conventional planar antenna.
Figure 1B:
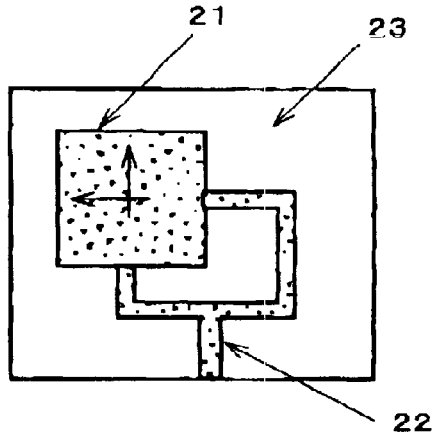
FIG. 1B (BACKGROUND ART)
Figure 1C:
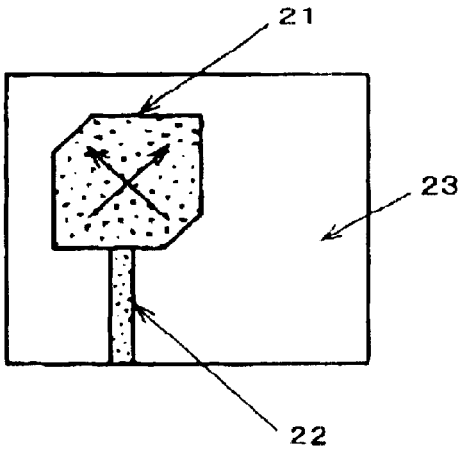
FIG. 1C (BACKGROUND ART)
Figure 1D:
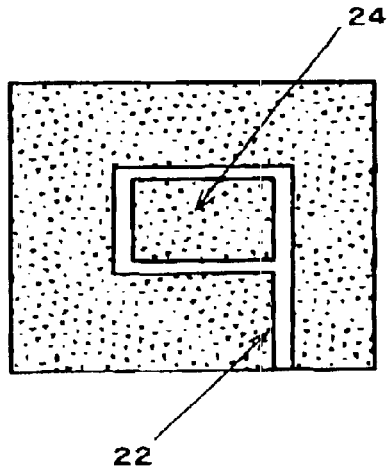
FIG. 1D (BACKGROUND ART)
Figure 2A:
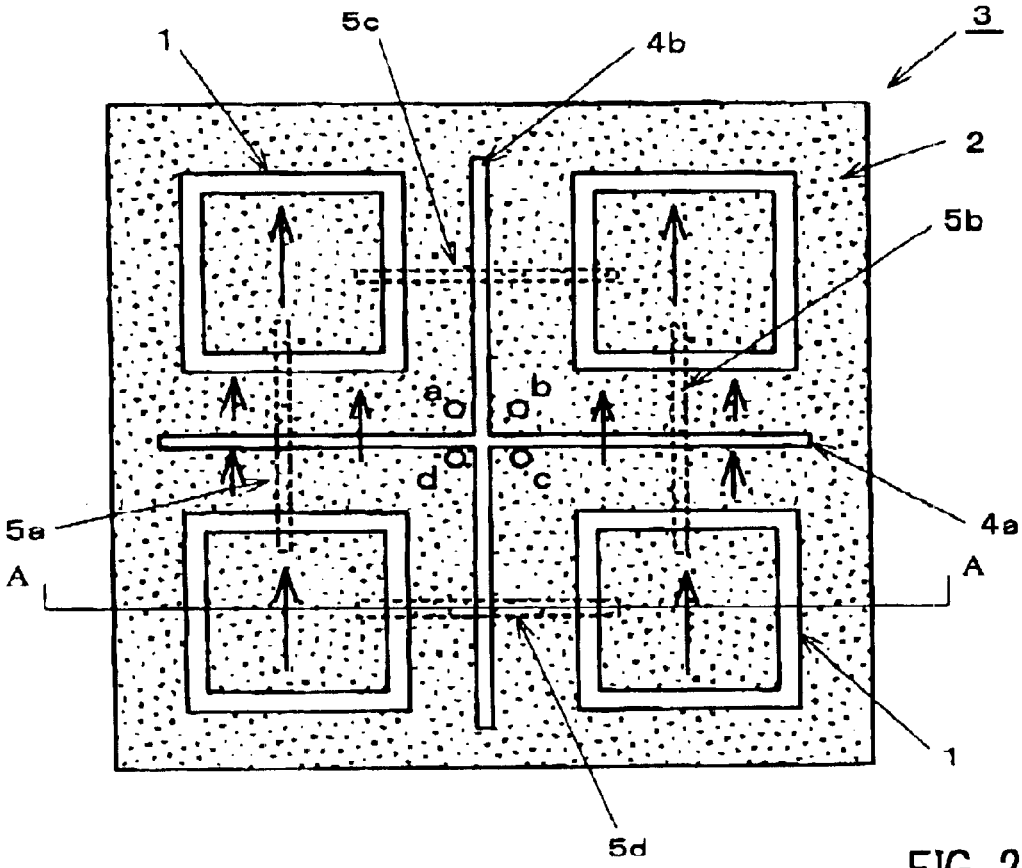
FIG. 2A is a plan view illustrating a slot line multi-element planar array antenna according to a first embodiment of the present invention.
Figure 2B:
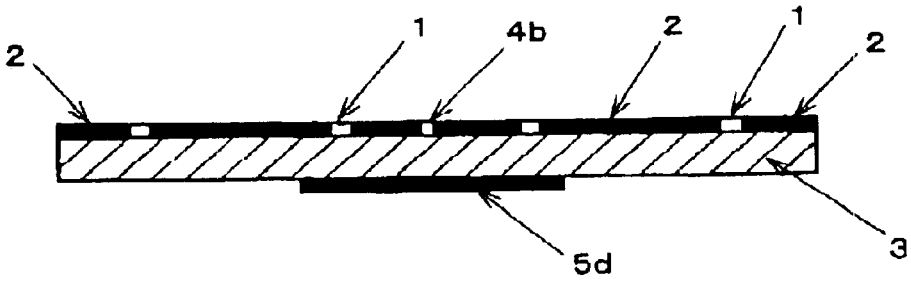
FIG. 2B is a cross-sectional view taken along line A—A in FIG. 2A.

A slot line multi-element planar array antenna according to a first embodiment of the present invention, illustrated in FIGS. 2A and 2B, comprises planar conductor 2 formed substantially over the entirety of a first principal surface of substrate 3 made, for example, of a dielectric material or the like. Conductor 2 is formed with first and second slot line 4*a*, 4*b* such that they intersect each other at their respective midpoints and extend orthogonal to each other. Conductor 2 is made, for example, of a metal layer or a thin metallic plate. In the figures, first slot line 4*a* extends in the horizontal direction, while second slot line 4*b* extends in the vertical direction. Slot lines 4*a*, 4*b* are formed as slot lines having the same length and short-circuited at both ends, in the shape of a cross as a whole. As will be later described, the planar antenna is fed at four corners formed at the intersection of slot lines 4*a*, 4*b* on conductor 2.

Further, four slot line type antenna elements 1 are disposed on the first principal surface of substrate 3. Specifically, antenna elements 1 are formed by routing slot lines each of which circumvents along the outer periphery of a square on conductor 2. Therefore, in a small square area surrounded by each slot line, conductor 2 still remains on substrate 3. A conductor in the small square area surrounded by each slot line is called the "central conductor of antenna element 1."

In FIG. 2A, a dotted portion indicates the location at which conductor 2 is formed on the first principal surface of substrate 3. In FIG. 2B, fat black line segments represent conductor 2 on the first principal surface and conductors which serve as microstrip lines on the second principal surface.

On the second principal surface of substrate 3, four microstrip lines 5*a* to 5*d* are routed at equal distances from the intersection of slot lines 4*a*, 4*b* in the vertical and horizontal directions such that microstrip lines 5*a* to 5*d* orthogonally traverse slot lines 4*a*, 4*b*, respectively. The leading end of each slot line 4*a*, 4*b*, which is short-circuited to form a termination, is preferably extended by approximately $\lambda/4$ beyond the position across which associated microstrip line 5*a* to 5*d* traverses, where $\lambda$ is a wavelength corresponding to the antenna frequency of the planar antenna. Therefore, each of the leading ends of each slot line 4*a*, 4*b* electrically functions as an open end, viewed from the intersection with the associated microstrip line, at the antenna frequency. Conductor 2 formed on the first principal surface of substrate 3 also functions as a ground plane or ground conductor for microstrip lines 5*a* to 5*d*.

All microstrip lines 5*a* to 5*d* have the same length, and are formed along the sides of a certain square as a whole. Slot line antenna elements 1 are disposed, respectively at positions corresponding to the corners of the square. Each of microstrip lines 5*a* to 5*d* formed on the second principal surface of substrate 3 has leading end portions each of which overlaps with the central conductor of associated antenna element 1 through substrate 3. Specifically, each of leading end of each microstrip line 5*a* to 5*d* traverses the slot line around the central conductor of corresponding antenna element 1, and extends below the central conductor. In this event, the microstrip line traverses the slot line formed in a square track shape at the center of one side of the square. The microstrip line thus traversing the slot line is electromagnetically coupled to the slot line of antenna element 1, resulting in electromagnetic coupling of the microstrip line with antenna element 1. Consequently, antenna element 1 can be fed from the microstrip line.

Antenna element 1 at the upper right corner in the figure overlaps with the right end of microstrip line 5*c* and an upper end of microstrip line 5*b* to create electromagnetic coupling with these ends of microstrip lines 5*c*, 5*b*, so that antenna element 1 is fed at two points from these microstrip lines 5*c*, 5*b*. Similarly, antenna element 1 at the lower right corner in the figure is electromagnetically coupled to the right end of microstrip line 5*d* and the lower end of microstrip line 5*b*; antenna element 1 at the upper left corner in the figure is electromagnetically coupled to the left end of microstrip line 5*c* and the upper end of microstrip line 5*a*; and antenna element 1 at the lower left corner in the figure is electromagnetically coupled to the left end of microstrip line 5*d* and the lower end of microstrip line 5*a*.

In this planar antenna, each antenna element 1 has a degeneration mode in the horizontal and vertical directions orthogonal to each other. The same electronic length is set from the intersection of first and second lot lines 4*a*, 4*b* to respective antenna elements 1 through slot lines 4*a*, 4*b* and microstrip lines 5*a* to 5*d*.

Next, the operation of the planar array antenna will be described. As described above, in this planar antenna, a high frequency signal is applied at a feed position composed of four corners on conductor 2 which are formed at the position at which first and second slot lines 4*a*, 4*b* intersect to each other. For convenience, the four corners are designated a, b, c, d in the clockwise direction from the upper left corner in the figure.

First, among four corners at the feed position, corners a, b above first slot line 4*a* are designated as a pair, while corners c, d below first slot line 4*a* are likewise designated as another pair. A high frequency signal is applied or fed between corners a, b and corners c, d. In this event, first slot line 4*a* is excited by the high frequency signal applied on both sides, permitting a high frequency component in a balanced mode to propagate through first slot line 4*a*. Then, the high frequency component is converted to an unbalanced mode by first and second microstrip lines 5*a*, 5*b* which traverse first slot line 4*a* on the left and right end sides, respectively. The converted high frequency component propagates to respective antenna elements 1. In each antenna element 1, the high frequency signals from the microstrip lines propagate in in-phase parallel branch with respect to the slot lines along which antenna element 1 is formed.

Since the conversion from the slot line to the microstrip line is made through an anti-phase series branch, the high frequency components converted to microstrip lines 5*a*, 5*b* propagate in opposite phase. Since the electric lengths from the intersection of slot lines 4*a*, 4*b* to respective antenna elements 1 are identical, respective antennas 1 are applied with the high frequency signal in opposite phase. However, respective antenna elements 1 are excited in phase because the feed points of the antennas are in a mirror symmetry relationship. In this event, since respective antennas 1 are fed in the vertical direction, a vertical polarization is fed. Also, in this event, since second slot line 4*b* is not excited, no high frequency component propagates through microstrip lines 5*c*, 5*d*.

Figure 3:
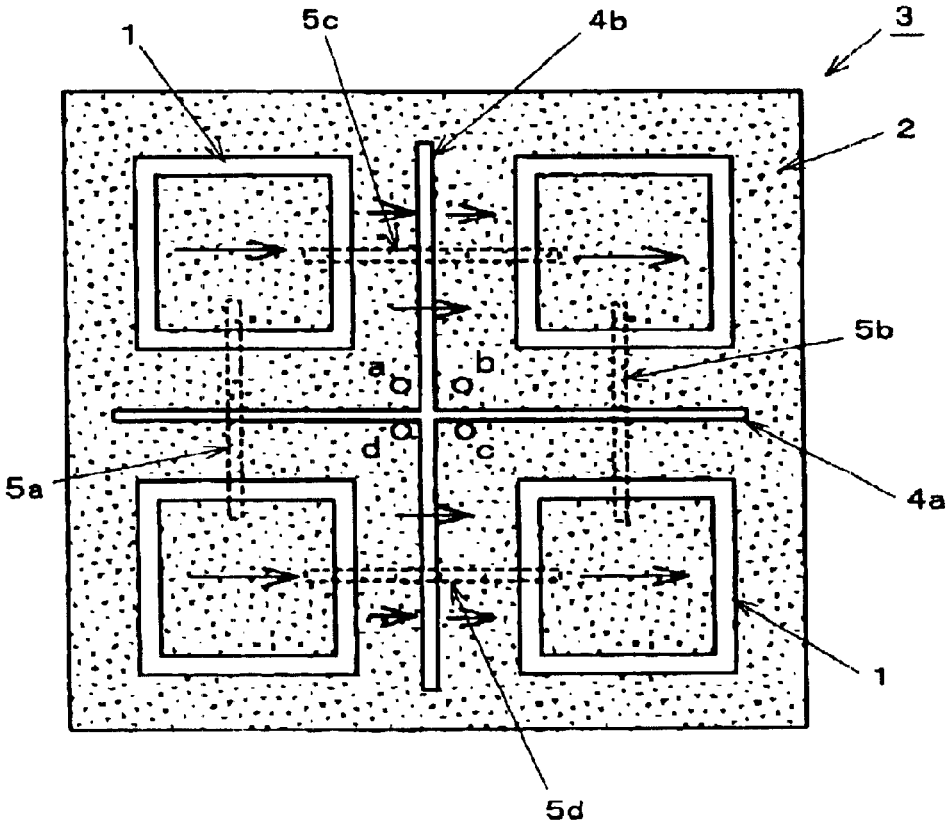
FIGS. 3 to 5 are plan views each illustrating an exemplary operation of the planar array antenna according to the first embodiment.

Next, as illustrated in FIG. 3, among four corners a, b, c, d at the intersection of slot lines 4*a*, 4*b*, corners a, d positioned on the left side of second slot 4*b* are designated as one pair, while corners b, c positioned on the right side of second slot line 4*b* are likewise designated as another pair. A high frequency signal is applied between corners a, d and corners b, c. In this event, second slot line 4*b* is excited by the high frequency signal applied on both sides, permitting a high frequency component in a balanced mode to propagate through second slot line 4*b*. The high frequency component is converted to an unbalanced mode by microstrip lines 5*c*, 5*d* which traverse second slot line 4*b* on the upper and lower end sides, respectively. The converted high frequency component propagate to respective antenna elements 1.

Since the transition from the slot line to the microstrip line is made through an anti-phase series branch, as is the case with the foregoing, the high frequency components converted by microstrip lines 5*c*, 5*d* propagate in opposite phase, so that respective antenna elements 1 are applied with the high frequency signal in opposite phase. However, since the feed points of the antennas are in a mirror symmetry relationship, respective antenna elements 1 are excited in phase. Since respective antennas 1 are fed in the horizontal direction, a horizontal polarization is supplied. Also, in this event, since first slot line 4*a* is not excited, no high frequency component propagates through microstrip lines 5*a*, 5*b*.

Figure 4:
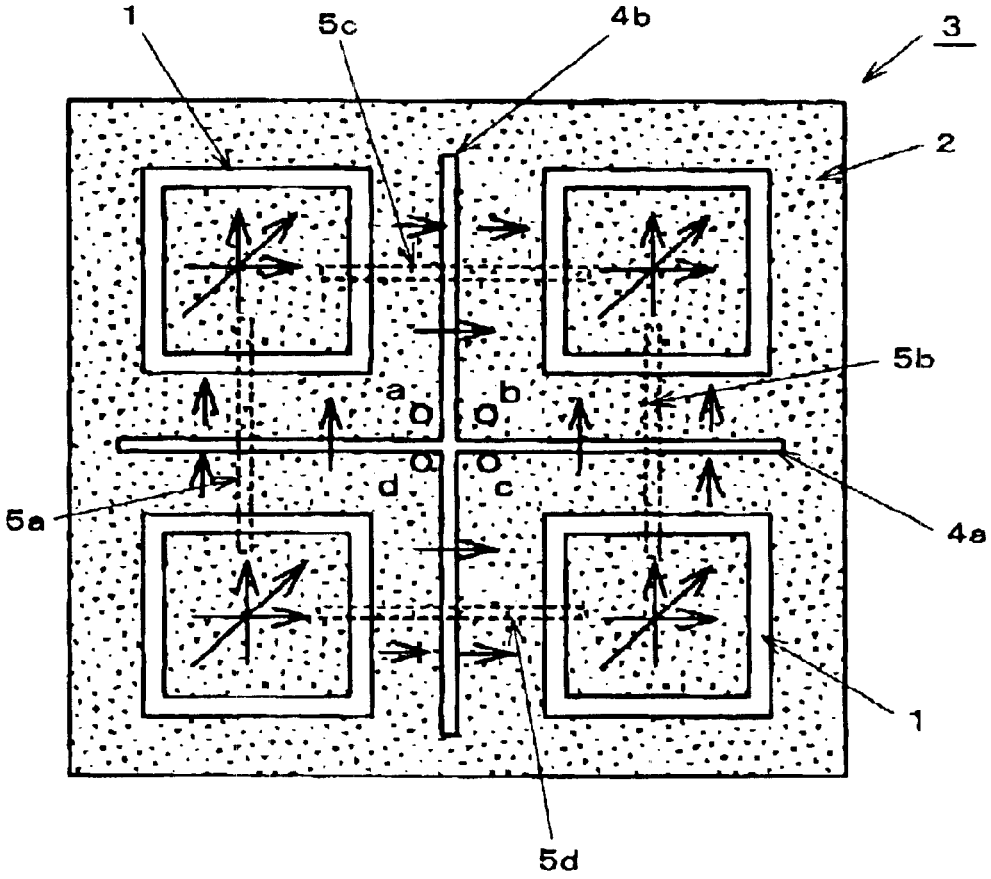

Further, as illustrated in FIG. 4, among four corners a, b, c, d at the intersection of slot lines 4*a*, 4*b*, a high frequency signal is applied between corners d, b on one diagonal. Since corners d, b remain electrically shut off to each other, an electric field is produced between corners b, c and corners c, d, while an electric field is also produced between corners b, a and corners a, d, thereby exciting in-phase high frequency signals having the same amplitude on first and second slot lines 4*a*, 4*b*. As a result, the high frequency signal excited on first slot line 4*a* propagates through first slot line 4*a*, and is branched in opposite phase and in series into microstrip lines 5*a*, 5*b* which traverse first slot line 4*a* on the left and right end sides, respectively. In this way, respective antenna elements 1 are fed in the vertical direction. Similarly, the high frequency signal excited on second slot line 4*b* propagates through second slot line 4*b*, and is branched in opposite phase and in series into microstrip lines 5*c*, 5*d* which traverse second slot line 4*b* on the upper and lower end sides, respectively. As a result, respective antenna elements 1 are fed also in the horizontal direction. Consequently, each antenna element 1 is fed with the high frequency signals in both the vertical and horizontal directions which are combined to form a linear polarization tilted by 45 degrees to the right, as indicated by a long arrow.

When the high frequency signal is applied between corners a, c in the diagonal direction opposite to the foregoing, instead of corners b, d, a linear polarization tilted by 45 degrees to the left, orthogonal to the direction tilted by 45 degrees to the right, is formed on a similar principle to the foregoing.

Figure 5:
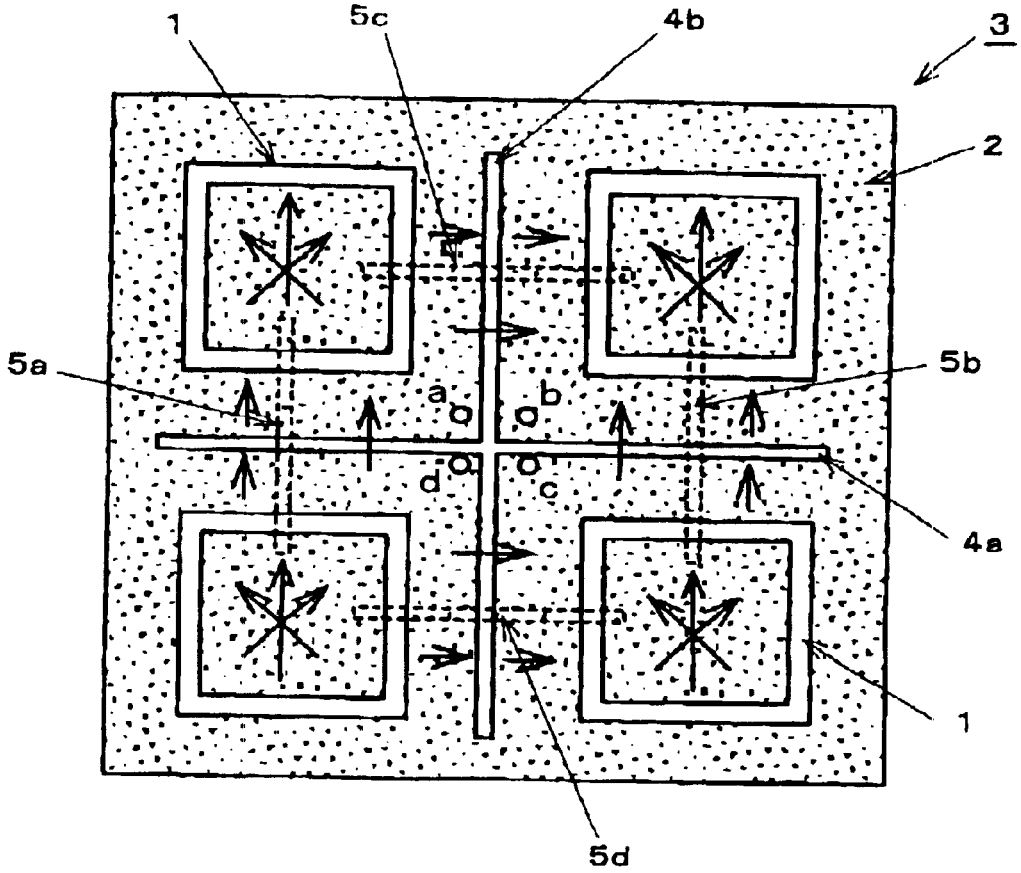

More further, when the high frequency signal is supplied between corners b, d in one diagonal direction out of four corners a, b, c, d at the intersection of slot lines 4*a*, 4*b* with an additional high frequency signal being applied between corners a, c in the other diagonal direction, the planar antenna operates as follows. Each antenna element 1 generates a linear polarization tilted by 45 degrees to the right in a similar manner to the foregoing by the high frequency signal applied between corners b, d, and a linear polarization tilted by 45 degrees to the left by the high frequency signal applied between corners a, c. Here, if the high frequency signal applied between corners a, c is identical in level and phase to the high frequency signal applied between corners b, d, the linear polarization tilted by 45 degrees to the right is combined with the linear polarization tilted by 45 degrees to the left to form a polarization substantially in the vertical direction, i.e., a vertical polarization, as Illustrated in FIG. 5. Thus, the linear polarization can be arbitrarily controlled in terms of the polarization direction by applying the high frequency signals at different levels to each other.

While the multi-element planar array antenna according to the first embodiment has been described with particular emphasis on the operation during transmission, the antenna operates in a manner similar to the foregoing during reception as well, as a matter of course. Also, while antenna element 1 is in the shape of a square, it can be in any shape as long as the degeneration mode can exist in the orthogonal directions. For example, the antenna element 1 can be formed of a slot line having a shape along a periphery of a rectangle or a circle on conductor 2 on the first principal surface of substrate 3.

Next, a slot line multi-element planar array antenna according to a second embodiment of the present invention will be described with reference to FIG. 6. This planar antenna is similar to the planar antenna according to the first embodiment except that the former is designed for use with a circular polarization.

Figure 6:
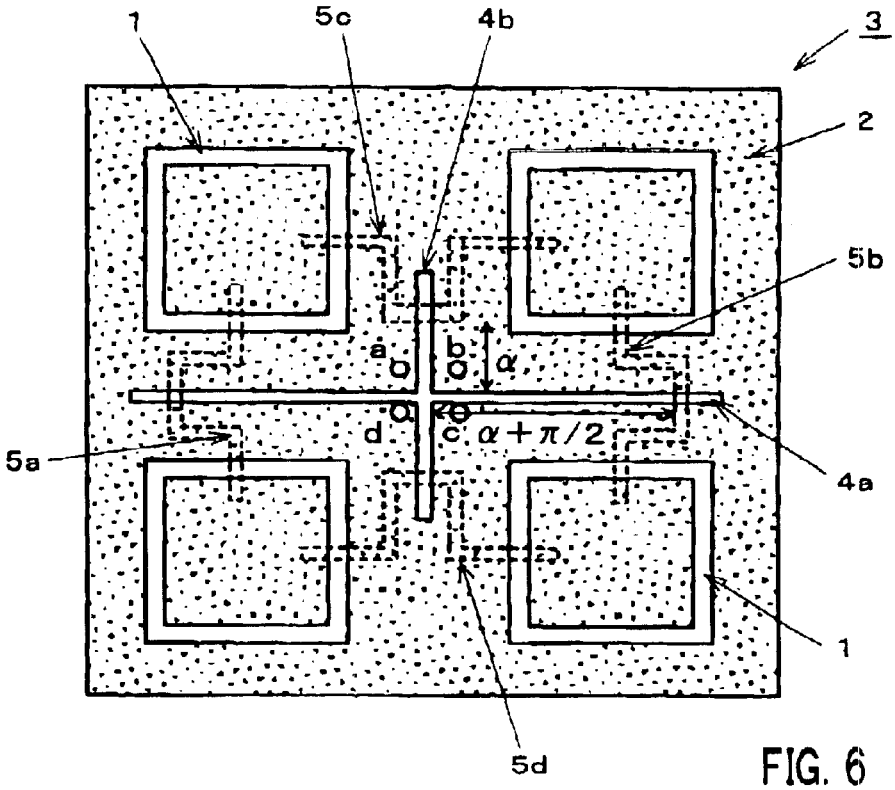
FIG. 6 is a plan view illustrating a slot line multi-element planar array antenna according to a second embodiment of the present invention.

The planar antenna illustrated in FIG. 6 largely differs from the planar antenna according to the first embodiment in that the electric length of first slot line 4*a* from the intersection of slot lines 4*a*, 4*b* to the point at which microstrip line 5*a*, 5*b* traverses first slot line 4*a* is different from the electric length of second slot line 4*b* from the intersection of slot lines 4*a*, 4*b* to the point at which microstrip line 5*c*, 5*d* traverses second slot line 4*b* by $\pi/2$ as calculated in terms of phase difference. In this example, each antenna element 1 is geometrically disposed at a corner of the square, and first slot line 4*a* extending in the horizontal direction is made longer than second slot line 4*b* extending in the vertical direction, In FIG. 6, the electric length from the intersection of slot lines 4*a*, 4*b* to the position at which second slot line 4*b* traverses microstrip lines 5*c*, 5*d* is designated by $\alpha$. Then, microstrip lines 5*a*, 5*b* extending in the vertical direction are bent in the shape of a crank to the outside in a central portion thereof, while microstrip lines 5*c*, 5*d* extending in the horizontal direction are bent in the shape of a crank to the inside in a central portion thereof. Each of microstrip lines 5*a* to 5*d* have ends electromagnetically coupled to associated antenna elements 1 through substrate 3.

In the configuration as described above, a vertically excited high frequency signal is delayed by $\pi/2$ in phase from a horizontally excited high frequency signal. Therefore, when the high frequency signal is applied between corners b, d, an electromagnetic wave propagating in front on the drawing sheet will be a right-handed circular polarization. Similarly, the high frequency signal applied between corners a, c will result in a left-handed circular polarization. In addition, as the high frequency signal is applied between corners b, d with additional high frequency signal applied between corners a, c, a right-handed circular polarization and a left handed circular polarization are excited simultaneously. In this manner, the right-handed circular polarization or left-handed circular polarization can be selected depending on which diagonal direction is selected at the intersection of slot lines 4*a*, 4*b* for applying the high frequency signal. Moreover, the right-handed circular polarization and left-handed circular polarization can be used together by applying the high frequency signal in both the diagonal directions. Consequently, the second embodiment can readily implement a slot line multi-element planar array antenna which can select one from orthogonal circular polarizations and can use these circular polarizations together.

In the example shown herein, a difference of $\pi/2$ as calculated in terms of a phase difference is provided between the electric lengths of first and second slot lines 4*a*, 4*b* from the intersection, in which case the basic operation still remains unchanged when second slot line 4*b* extending in the vertical direction is made longer in the electric length from the intersection by $\pi/2$ than first slot line 4*a* extending in the horizontal direction. Alternatively, slot lines 4*a*, 4*b* may be equal in the electric length, whereas a difference corresponding to a phase difference of $\pi/2$ may be provided between microstrip lines 5*a*, 5*b* and microstrip line 5*c*, 5*d*. Moreover, it is still possible to select one of the circular polarizations or use both the polarizations together when this difference in the electric length is appropriately distributed between the slot lines and microstrip lines as long as the difference between the electric lengths from the intersection of slot lines 4*a*, 4*b* to two feed points of each antenna element 1 remains to be totally $\pi/2$ as calculated in terms of phase difference.

Figure 7:
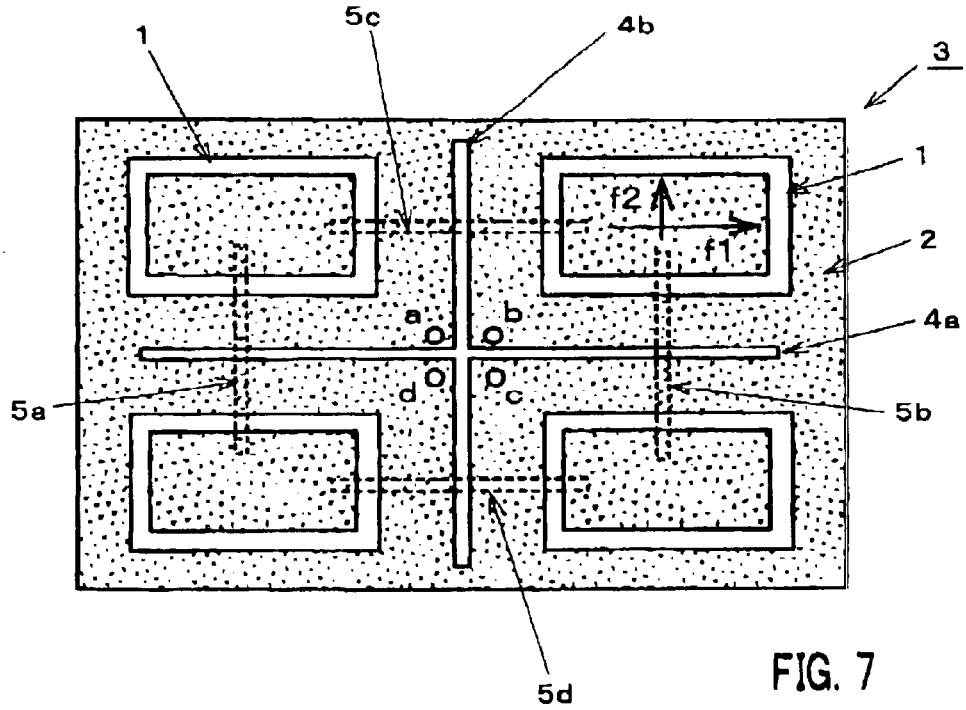
FIG. 7 is a plan view illustrating a slot line multi-element planar array antenna according to a third embodiment of the present invention.

Next, a slot line multi-element planar array antenna according to a third embodiment of the present invention will be described with reference to FIG. 7. The planar antennas in the respective embodiments described above are each configured to select a polarization component and use together different polarization components at the same operating frequency of the antenna, whereas the planar antenna illustrated in FIG. 7 is configured to use together different operating frequencies. Specifically, the planar antenna illustrated in FIG. 7 is similar to the one illustrated in FIGS. 2A and 2B except that a rectangular circuit conductor is used for antenna element 1. Antenna element 1 has a slot line which circumvents along the periphery of a rectangle having long sides and short sides. More specifically, antenna frequency $f_1$ in a horizontal polarization resulting from the horizontal dimension of antenna element 1 is different from antenna frequency $f_2$ in a vertical polarization resulting from the vertical dimension. For convenience, suppose herein that antenna frequency $f_2$ is higher than antenna frequency $f_1$ (i.e., $f_2>f_1$) on the assumption that antenna element 1 is longer from side to side, as illustrated.

In the configuration as described above, as a high frequency signal is applied between corners a, b and corners c, d, for example, at the intersection of first and second slot lines 4*a*, 4*b*, first slot line 4*a* extending in the horizontal direction is excited. Then, each antenna element 1 is fed in the vertical direction through microstrip lines 5*a*, 5*b*. Thus, the planar antenna can be operated at antenna frequency $f_2$ with the vertical polarization. Similarly, as a high frequency signal is applied between corners a, d and corners b, c, second slot line 4*b* extending in the vertical direction is excited, so that each antenna element 1 is fed in the horizontal direction through microstrip lines 5*c*, 5*d*. Thus, the planar antenna can be operated at antenna frequency $f_1$ with the horizontal polarization. From the foregoing, the resulting slot line multi-element planar array antenna can be operated at two frequencies selected through the orthogonal linear polarizations.

Preferably, in the planar antenna according to the third embodiment, both ends of first slot line 4*a* extend beyond the positions at which microstrip lines 5*a*, 5*b* traverse first slot line 4*a* by one quarter wavelength with respect to antenna frequency $f_2$. Likewise, both ends of second slot line 4*b* preferably extend beyond the positions at which microstrip lines 5*c*, 5*d* traverse second slot line 4*b* by one quarter wavelength with respect to antenna frequency $f_1$.

Next, a slot line multi-element planar array antenna according to a fourth embodiment of the present invention will be described with reference to FIGS. 8A and 8B. Particularly shown herein is a specific method of feeding the slot line multi-element planar array antenna having four antenna elements, illustrated in the first embodiment.

Figure 8A:
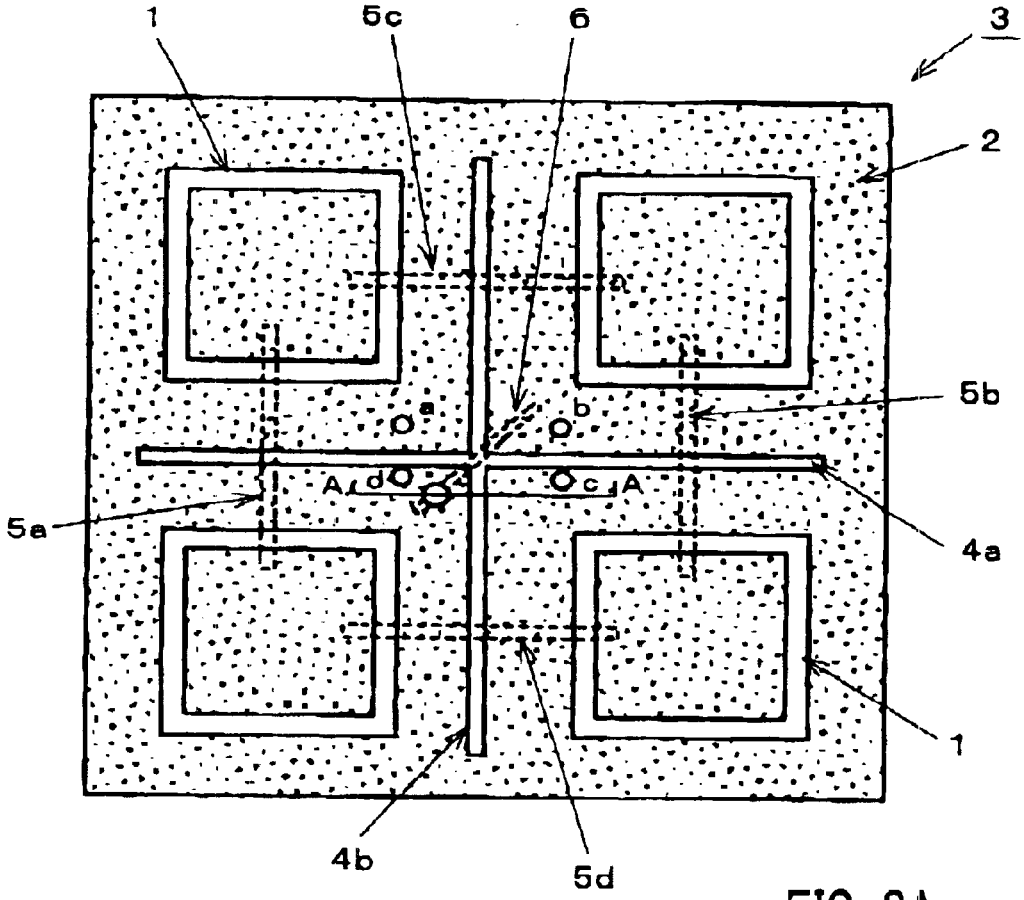
FIG. 8A is a plan view illustrating a slot line multi-element planar array antenna according to a fourth embodiment of the present invention.
Figure 8B:
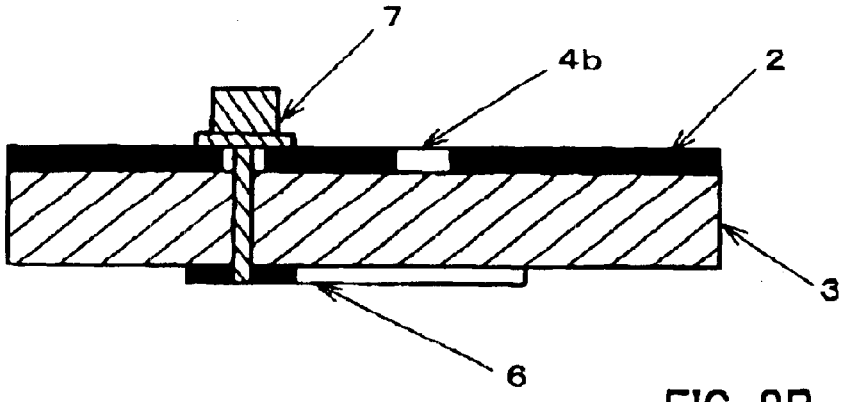
FIG. 8B is a cross-sectional view taken along line A—A in FIG. 8A.

FIGS. 8A and 8B illustrate an example in which the planar antenna is fed between corners b, d positioned in one diagonal direction at the intersection of first and second slot lines 4*a*, 4*b* on the first principal surface of substrate 3. In this example, a feed microstrip line 6 electromagnetically coupled to corners b, d is provided on the second principal surface of substrate 3 and for feeding a high frequency signal to corners b, d through microstrip line 6. Microstrip line 6 extends in the diagonal direction including corners b, d and passes immediately above the position at which first and second slot lines 4*a*, 4*b* intersect. The length from the intersection to an open end of microstrip line 6 is set to approximately one quarter wavelength with respect to a designed center frequency of the planar antenna. The other end of microstrip line 6 is connected to feed connector 7 disposed on the first principal surface of substrate 3 through a via hole. For example, a coaxial cable, not shown, is connected to feed connector 7.

In the configuration as described above, the planar array antenna according to the fourth embodiment can readily transmit the aforementioned linear polarization tilted by 45 degrees to the right by applying a high frequency signal from the coaxial cable between corners b, d in the one diagonal direction at the intersection of slot lines 4*a*, 4*b* through feed microstrip line 6. Likewise, the planar array antenna can readily receive the linear polarization tilted by 45 degrees to the right in the same configuration. In addition, a similar feed microstrip line may be used for applying a high frequency signal between corners a, c, between corners a, b and corners c, d, and between corners a, d and corners b, c. In these events, the planar array antenna can use a linear polarization tilted by 45 degrees to the left together with the linear polarization tilted by 45 degrees to the right when feed microstrip lines are formed not only in one diagonal direction, i.e., in the direction of corners b, d but also in the other diagonal direction, i.e., in the direction of corners a, c.

As described above, the multi-element planar array antenna based on the present invention can be fed by simply disposing feed microstrip line 6. This feature can be applied not only to the planar array antenna according to the first embodiment for use with a linear polarization but also to the planar array antenna according to the second embodiment for use with a circular polarization.

Figure 9A:
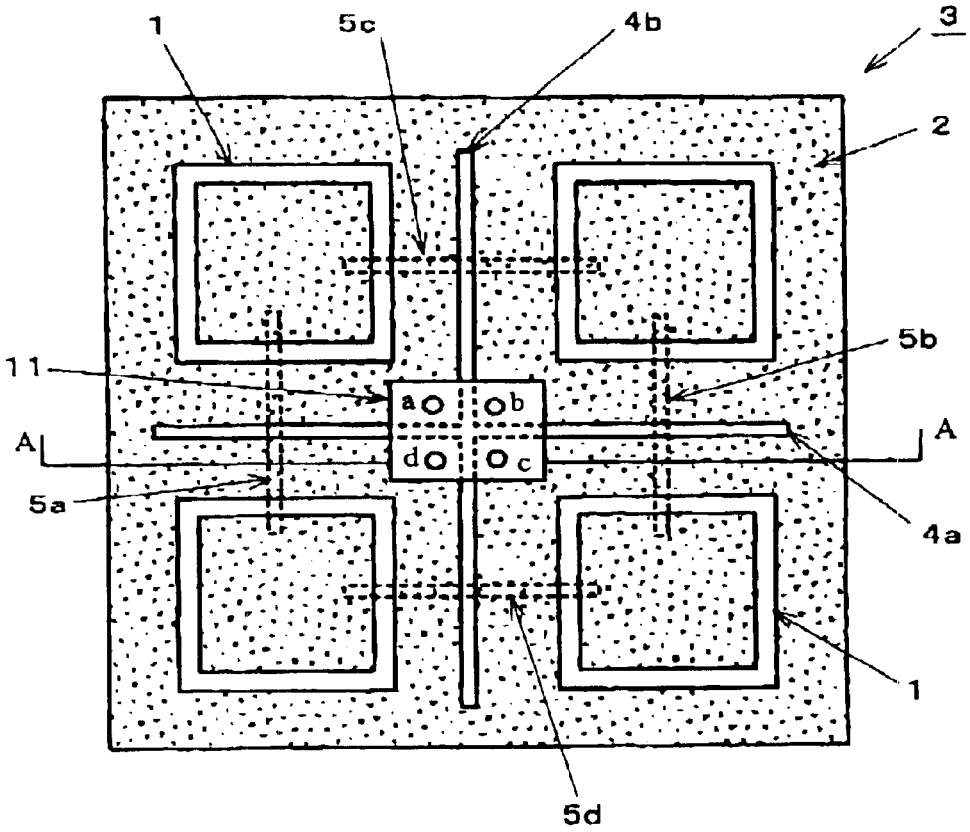
FIG. 9A is a plan view illustrating a slot line multi-element planar array antenna according to a fifth embodiment of the present invention.
Figure 9B:
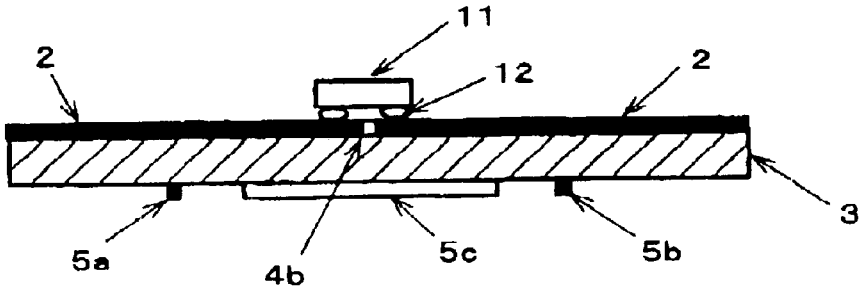
FIG. 9B is a cross-sectional view taken along line A—A in FIG. 9A.

Next, a slot line four-element planar array antenna according to a fifth embodiment of the present invention will be described with reference to FIGS. 9A and 9B. In this planar antenna, functional circuit 11, for example, a semiconductor device, an integrated circuit or the like is mounted by surface mounting, flip chip bump technique or the like, at the intersection of slot lines 4*a*, 4*b* on the first principal surface of substrate 3 in the planar antenna of the first embodiment. Functional circuit 11 permits a high frequency signal to be selectively applied to corners a, b, c, d at the intersection of the slot lines through functional circuit 11. In the illustrated configuration, functional circuit 11 is connected to the respective corners through bumps 12.

In the configuration as described above, functional circuit 11 may be controlled to facilitate a selection of applying a high frequency signal between corners b, d; between corners a, c; between corners a, b and corners c, d; and between corners a, d and corners b, c, thereby enabling the planar antenna to transmit and receive a polarization tilted by 45 degrees to the right, a polarization tilted by 45 degree to the left, a horizontal polarization, and a vertical polarization. From the foregoing, the planar antenna according to the fifth embodiment can readily select one from the linear polarizations listed above, and use such linear polarizations together. Generally, a millimeter-wave communication system suffers from a large loss on feed lines on top of small power generated from an oscillation element. Such a problem on the loss can be solved by incorporating an active device such as an amplifier, a frequency converter and the like in the slot line multi-element planar array antenna as functional circuit 11. Further functions can be added to the slot line multi-element planar array antenna to implement an active antenna or an adaptive array antenna. In addition, the configuration provided by the fifth embodiment is suitable for a smart antenna for controlling a main beam and suppressing interfering waves because of its ability to appropriately control and select a polarization.

Figure 10A:
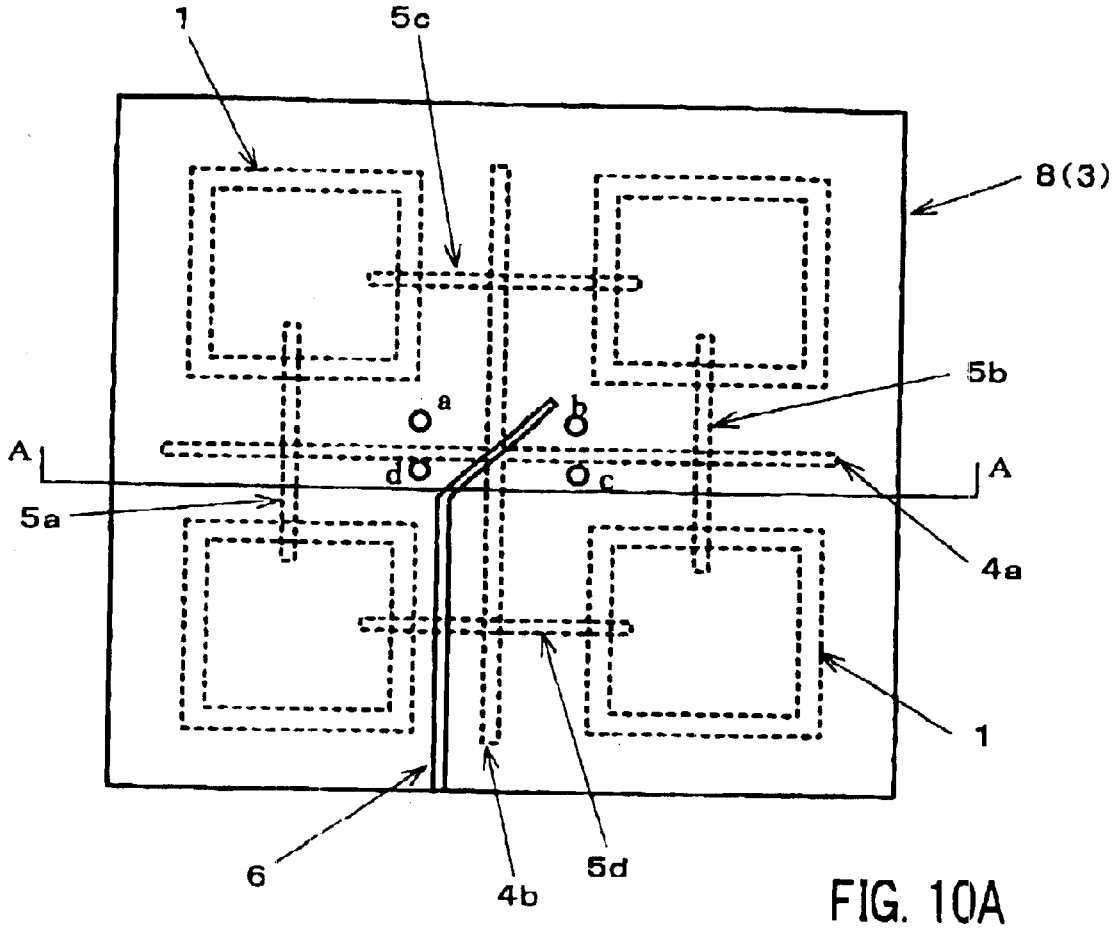
FIG. 10A is a plan view illustrating a slot line multi-element planar array antenna according to a sixth embodiment of the present invention.
Figure 10B:
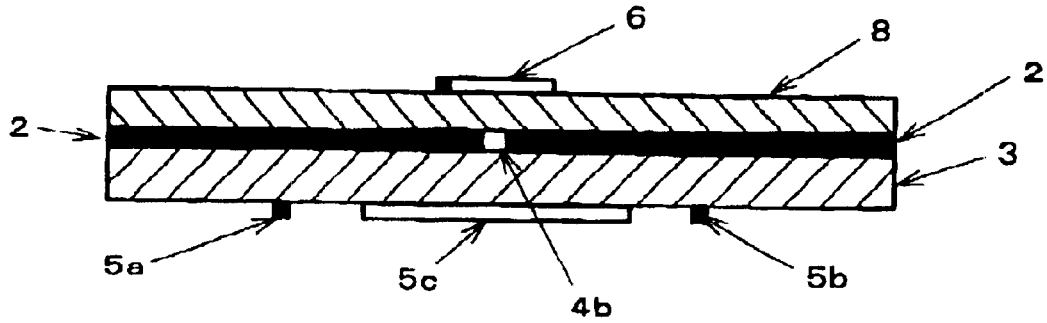
FIG. 10B is a cross-sectional view taken along line A—A in FIG. 10A.

Next, a slot line multi-element planar array antenna according to a sixth embodiment of the present invention will be described with reference to FIGS. 10A and 10B.

This embodiment is similar to the fifth embodiment in that it shows a structure for feeding the multi-element planar array antenna. However, while the fifth embodiment has shown that substrate 3 having a single layer structure is fed, the planar antenna according to the sixth embodiment comprises a feeder circuit in a multi-layered substrate which eliminates via holes.

In the planar antenna according to the sixth embodiment, second substrate 8 made of a dielectric material or the like is laminated on substrate 3 with one principal surface of second substrate 8 opposing the first principal surface of substrate 3 in the planar antenna according to the first embodiment. Feed microstrip line 6 is formed on the other principal surface of second substrate 8. Microstrip line 6 has a leading end electromagnetically coupled to corners b, d in one diagonal direction at the intersection of slot lines 4*a*, 4*b* through second substrate 8. The other end of microstrip line 6 is led to an end of second substrate 8 at which a coaxial cable, not shown, or the like is connected.

In the configuration as described above, a high frequency signal is applied between corners b, d at the intersection of slot lines 4*a*, 4*b* through feed microstrip line 6 provided on the principal surface of the multi-layered substrate, i.e., the other principal surface of second substrate 8, enabling the planar antenna to transmit and receive the aforementioned linear polarization tilted by 45 degrees to the right. In addition, the elimination of via hole results in a suppressed reflection loss and circuit loss. As will be appreciated, with additional microstrip lines 6 thus provided, the resulting slot line multi-element planar array antenna of the sixth embodiment can transmit and receive a linear polarization tilted by 45 degrees to the left, a horizontal polarization, and a vertical polarization as well as can use together circular polarizations and linear polarizations.

Further, in the sixth embodiment, the aforementioned functional circuit such as a semiconductor device and IC may be mounted on the other principal surface of second substrate 8, or a circuit board comprising a transmission line electromagnetically coupled to feed microstrip line 6 and a functional circuit may be laminated on second substrate 8 to implement an active antenna or a smart antenna.

Figure 11A:
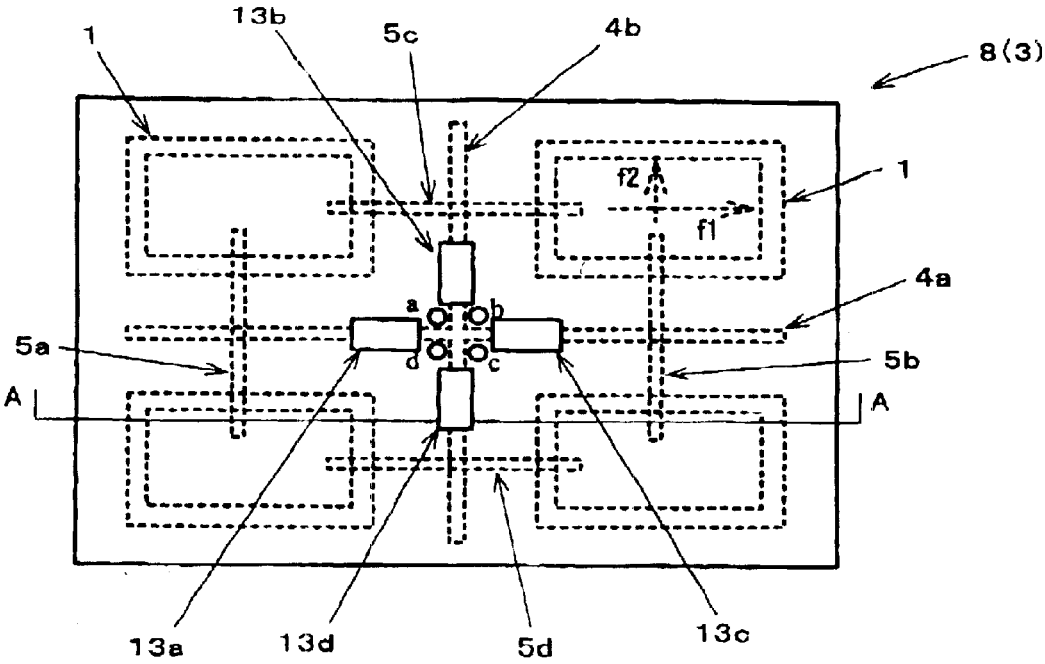
FIG. 11A is a plan view illustrating a slot line multi-element planar array antenna according to a seventh embodiment of the present invention.
Figure 11B:
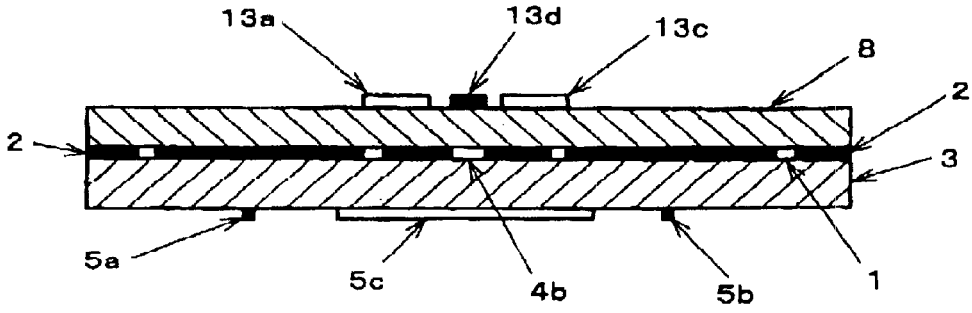
FIG. 11B is a cross-sectional view taken along line A—A in FIG. 11A.

Next, a slot line multi-element planar array antenna according to a seventh embodiment of the present invention will be described with reference to FIGS. 11A and 11B.

In this planar antenna, second substrate 8 made of a dielectric material or the like is laminated on substrate 3 with one principal surface of second substrate 8 opposing the first principal surface of substrate 3, on which slot lines 4*a*, 4*b* are formed, in the planar antenna illustrated in FIG. 7. Feed microstrip lines 13*a* to 13*d* are formed on the other principal surface of second substrate 8 such that they overlap first and second slot lines 4*a*, 4*b* within the region from the intersection of slot lines 4*a*, 4*b* to positions at which microstrip lines 5*a* to 5*d* traverse these slot lines 4*a*, 4*b*.

In the configuration as described above, as a high frequency signal is applied, for example, to feed microstrip lines 13*a*, 13*c* extending in the horizontal direction, an electric field is produced between corners a, d and corners b, C at the intersection of slot lines 4*a*, 4*b* by electromagnetic coupling from microstrip lines 13*a*, 13*c*, thereby exciting second slot line 4*b* extending in the vertical direction as illustrated. Consequently, each antenna element 1 is fed in the horizontal direction through microstrip lines 5*c*, 5*d*. Similarly, as a high frequency signal is applied to feed microstrip lines 13*b*, 13*d* extending in the vertical direction, first slot line 4*a* extending in the horizontal direction is excited, so that each antenna element 1 is fed in the vertical direction through microstrip lines 5*a*, 5*b*.

While the seventh embodiment has illustrated a planar antenna which has rectangular antenna elements 1 and operates at two antenna frequencies $f_1$, $f_2$, the seventh embodiment can be applied as well to a planar antenna which has square antenna elements 1. Similar to the aforementioned sixth embodiment, the functional circuit such as a semiconductor device and IC may be mounted on the other principal surface of second substrate 8, or a circuit board comprising a transmission line electromagnetically coupled to microstrip lines 13*a* to 13*d* and a functional circuit may be laminated on second substrate 8 to readily implement an active antenna or a smart antenna.

Next, a slot line multi-element planar array antenna according to an eighth embodiment of the present invention will be described with reference to FIG. 12. The number of antenna elements in the multi-element planar array antenna of the present invention is not limited to four, but any number of antenna elements such as 8, 16, 64 and the like may be provided. Therefore, described herein is a 16-element planar array antenna for use with a linear polarization based on the present invention.

Figure 12:
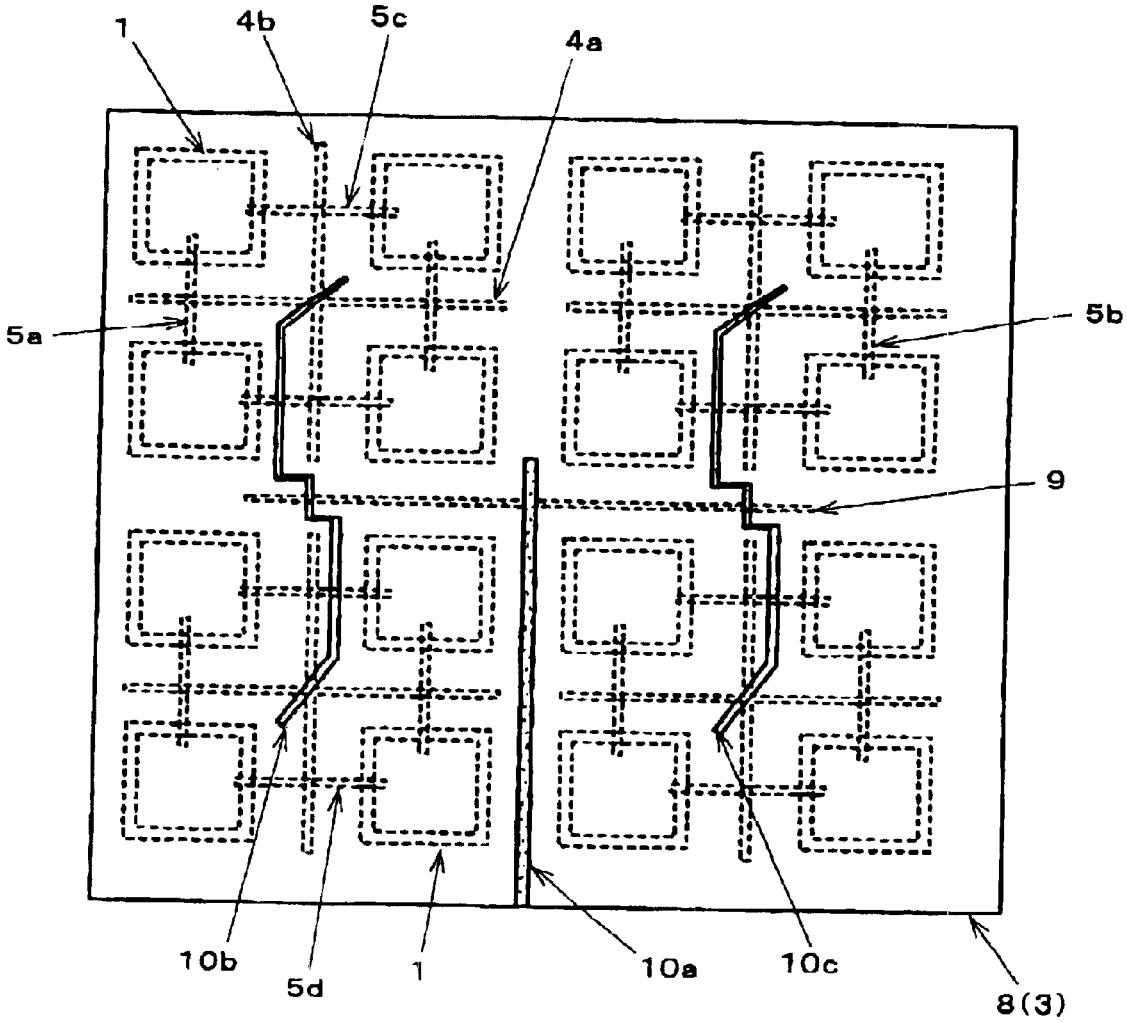
FIG. 12 is a plan view illustrating a slot line multi-element planar array antenna according to, an eighth embodiment of the present invention.

The planar antenna illustrated in FIG. 12 comprises four sets of the planar array antenna structures described in the first embodiment which are arranged on the same substrate 3 in 2×2 matrix configuration. Therefore, four sets of slot lines 4*a*, 4*b* as well as a total of 16 slot line antenna elements 1 are formed on the first principal surface of substrate 3, while a total of 16 microstrip lines are formed on the principal surface of substrate 3.

A specific feeding method in the eighth embodiment may be, for example, as follows. Feed slot line 9 extending in the horizontal direction is disposed on a first principal surface of substrate 3 between two upper sets and lower sets of four-element planar array antennas disposed as illustrated. Next, as described in connection with the sixth embodiment, second substrate 8 is laminated on the first principal surface of substrate 3, and feed microstrip lines 10*a* to 10*c* are formed on the other principal surface, i.e., the exposed surface of second substrate 8. Microstrip line 10*a* traverses feed slot line 9 and is electromagnetically coupled thereto. Feed microstrip lines 10*b*, 10*c* have their central portions electromagnetically coupled to slot line 9 on both end sides of slot line 9. Microstrip lines 10*b*, 10*c* have their both end sides electromagnetically coupled to the intersection of the slot lines in the upper and lower four-element planar array antennas, arranged side by side, for feeding between corners b, c, in a manner similar to microstrip line 6 (see FIGS. 10A and 10B) in the planar antenna of the sixth embodiment.

In the configuration as described above, a high frequency signal applied from microstrip line 10*a* is branched at the center of feed slot line 9 in parallel and in phase for distribution. Then, the high frequency signal is branched in opposite phase and in series on both end sides of slot line 9, and distributed to microstrip lines 10*b*, 10*c*, respectively. Thus, the high frequency signal is applied in phase between corners b, c at the intersection of the slot lines in each of the four sets of four-element planar array antennas. In this manner, a total of 16 antenna elements in the sets transmit and receive a linear polarization tilted by 45 degrees to the right. The resulting 16-element planar array antenna provides a higher sensitivity.

While the foregoing description has been made on a 16-element planar array antenna, an 8-element planar array antenna can be provided by electromagnetically coupling one end of a feed slot line to the midpoint of microstrip line 10*b* for feeding two sets of four-element planar array antennas disposed one above the other, and using the other end of the feed slot line as a feed end. Also, a 32-element planar array antenna can be provided by disposing a pair of 16-element planar array antennas disposed one above the other in a mirror symmetry, commonly connecting microstrip lines 10*a* of the respective 16-element allay antennas, and providing another feed slot line which traverses the midpoint of microstrip line 10*a* and is electromagnetic coupled thereto.

While the 16-element planar array antenna described above is designed for use with a linear polarization, a 16-element planar array antenna for use with a circular polarization can be configured in a similar manner by combining, for example, four sets of the planar array antennas of the second embodiment.

In the planar array antennas according to the respective embodiments of the present invention described above, electromagnetic waves are radiated from both principal surfaces of substrate 3. For radiating an electromagnetic wave only from one of the principal surfaces of substrate 3, an electromagnetic shielding box, a shielding plate, a reflector or the like may be provided on the principal surface opposing to that from which the electromagnetic wave is irradiated.

What is claimed is:

1. A multi-element planar array antenna comprising:

a substrate having a first and a second principal surface;

a conductor formed on said first principal surface;

a first and a second slot line formed in said conductor, and intersecting each other;

a first and a second microstrip line formed on said second principal surface, and traversing said first slot line respectively at positions corresponding to both end sides of said first slot line;

a third and a fourth microstrip line formed on said second principal surface, and traversing said second slot line respectively at positions corresponding to both end sides of said second slot line;

a first antenna element electromagnetically coupled to one end of said first microstrip line and to one end of said third microstrip line through said substrate;

a second antenna element electromagnetically coupled to one end of said second microstrip line and to the other end of said third microstrip line through said substrate;

a third antenna element electromagnetically coupled to the other end of said second microstrip line and to one end of said fourth microstrip line through said substrate; and a fourth antenna element electromagnetically coupled to the other end of said first microstrip line and to the other end of said fourth microstrip line through said substrate, wherein each of said antenna elements is a slot line antenna element formed on said first principal surface and capable of being excited in two directions.

2. The antenna according to claim 1, wherein each of said antenna elements includes a slot line formed on said conductor to be electromagnetically coupled to ends of the corresponding microstrip line.

3. The antenna according to claim 2, wherein said slot line of each said antenna element is formed in a loop manner.

4. The antenna according to claim 1, wherein said antenna includes a feed position at an intersection of said first and second slot lines, through which a high frequency signal is applied between at least two selected from four corners formed on said conductor at said intersection to select an excitation mode for each said antenna element.

5. The antenna according to claim 4, wherein said first and second microstrip lines extend in directions orthogonal to each other, and said first slot line matches with said second slot line at their respective midpoints to define said intersection.

6. The antenna according to claim 4, wherein each said antenna element has two feed points at which said two microstrip lines are electromagnetically coupled to said antenna element, respectively, and electric lengths are all equal from said intersection to said respective feed points through said respective slot lines and said microstrip lines.

7. The antenna according to claim 6, wherein said first and second slot lines are equal in length.

8. The antenna according to claim 6, wherein a high frequency signal is applied on both sides of one or said first and second slot lines between a pair of said corners positioned on respective sides of said slot line at said intersection.

9. The antenna according to claim 6, wherein a high frequency signal is applied between a pair of corners positioned in one diagonal direction out of said four corners at said intersection.

10. The antenna according to claim 6, wherein a first high frequency signal is applied between a pair of corners positioned in a first diagonal direction, and a second high frequency signal is applied between a pair of corners positioned in a second diagonal direction different from said first diagonal direction at said intersection.

11. The antenna according to claim 6, wherein each said antenna element is in a shape of a square.

12. The antenna according to claim 4, wherein each said antenna element has two feed points at which said two microstrip lines are electromagnetically coupled to said antenna element, respectively, and an electric length from said intersection to one feed point through said first slot line differs from an electric length from said intersection to the other feed point through said second slot line by $\pi/2$ as calculated in terms of phase.

13. The antenna according to claim 12, wherein a high frequency signal is applied between a pair of corners positioned in one diagonal direction out of said four corners at said intersection.

14. The antenna according to claim 12, wherein a first high frequency signal is applied between a pair of corners positioned in a first diagonal direction, and a second high frequency signal is applied between a pair of corners positioned in a second diagonal direction different from said first diagonal direction at said intersection.

15. The antenna according to claim 4, wherein each said antenna element is in a shape of a rectangle, and a high frequency signal is applied between a pair of corners positioned in one diagonal direction out of said four corners at said intersection.

16. The antenna according to claim 4, wherein each said antenna element is in a shape of a rectangle, and a high frequency signal is selectively applied between a first pair of corners positioned in a first diagonal direction or between a second pair of corners positioned in a second diagonal direction different from said first diagonal direction out of said four corners at said intersection.

17. The antenna according to claim 4, further comprising a feed microstrip line disposed on said second principal surface and traversing said intersection.

18. The antenna according to claim 4, further comprising a functional circuit disposed on said first principal surface and connected to said intersection for controlling a feed to said each corner.

19. The antenna according to claim 4, further comprising;

a second substrate bonded on said second principal surface, said second substrate having one principal surface opposing said second principal surface; and a feed microstrip line routed on the other principal surface of said second substrate, and traversing said intersection such that said feed microstrip line is electromagnetically coupled to a pair of corners at said intersection.

20. The antenna according to claim 4, further comprising:

a second substrate bonded on said second principal surface, said second substrate having one principal surface opposing said second principal surface; and a first to a fourth feed microstrip line formed on the other principal surface of said second substrate such that said microstrip lines overlap said first and second slot lines across said intersection.

21. A multi-element planar array antenna comprising:

a substrate having a first and a second principal surface;

a conductor formed on said first principal surface;

two or more planar antenna units formed on said substrate, said each planar antenna unit comprising a first and a second slot line formed in said conductor, and intersecting each other; a first and a second microstrip line formed on said second principal surface, and traversing said first slot line respectively at positions corresponding to both end sides of said first slot line; a third and a fourth microstrip line formed on said second principal surface; and traversing said second slot line respectively at positions corresponding to both end sides of said second slot line; four slot line antenna elements formed respectively in intersection regions between both end sides of said first and second microstrip lines and both end sides of said third and fourth microstrip lines, respectively, in two directions on said second principal surface; and a feed position at an intersection of said first and second slot lines;

a second substrate bonded on said second principal surface, said second substrate having one principal surface opposing said second principal surface; and a feed microstrip(line routed on the other principal surface of said second substrate, and traversing a pair of said intersections, wherein said antenna elements on said each planar antenna set are excited in phase.

22. The antenna according to claim 21, further comprising a feed slot line formed on said conductor and electromagnetically coupled to said feed microstrip line.

* * * * *